US008925676B2

(12) United States Patent
Murray

(10) Patent No.: US 8,925,676 B2
(45) Date of Patent: Jan. 6, 2015

(54) PORTED AUDIO SPEAKER ENCLOSURES

(71) Applicant: JDA Technology LLC, Orlando, FL (US)

(72) Inventor: Jimmy Lee Murray, Concordia, MO (US)

( * ) Notice: Subject to any disclaimer, the term of this patent is extended or adjusted under 35 U.S.C. 154(b) by 0 days.

(21) Appl. No.: 13/912,251

(22) Filed: Jun. 7, 2013

(65) Prior Publication Data

US 2013/0327585 A1 Dec. 12, 2013

Related U.S. Application Data

(60) Provisional application No. 61/656,658, filed on Jun. 7, 2012.

(51) Int. Cl.
*H04R 1/02* (2006.01)
*A47B 81/06* (2006.01)

(52) U.S. Cl.
CPC ..... *A47B 81/06* (2013.01)
USPC ..... 181/199; 181/153

(58) Field of Classification Search
CPC ..... H04R 1/021; H04R 2201/021; H04R 1/2815; H04R 1/2819; H04R 1/2853; H04R 1/2857; H04R 1/2861; H04R 1/2865; H04R 1/345
USPC ..... 181/148, 150, 153, 155, 156, 199; 381/341, 349, 350, 352
See application file for complete search history.

(56) References Cited

U.S. PATENT DOCUMENTS 2,646,852 A * 7/1953 Forrester ..... 181/156
3,327,808 A * 6/1967 Shaper ..... 181/153
3,529,691 A * 9/1970 Wesemann ..... 181/156
3,687,221 A * 8/1972 Bonnard ..... 181/180
4,168,761 A * 9/1979 Pappanikolaou ..... 181/156
5,721,786 A * 2/1998 Carrington ..... 381/423
6,062,339 A * 5/2000 Hathaway ..... 181/156
6,339,649 B1 1/2002 Chen et al.

(Continued)

FOREIGN PATENT DOCUMENTS

JP 2004032040 1/2001
JP 2007104620 4/2007
JP 2009065369 3/2009

OTHER PUBLICATIONS

PCT International Searching Authority:, PCT International Search Report dated Sep. 27, 2013, entire document.

*Primary Examiner* — Jeremy Luks
(74) *Attorney, Agent, or Firm* — Allen, Dyer, Doppelt, Milbrath & Gilchrist

(57) ABSTRACT

Speaker performance can be improved by routing sound from a rear side of speaker through a circuitous port formed between inner and outer surfaces of a wall of the speaker enclosure. An audio speaker enclosure comprises an enclosure housing defining an internal volume with a speaker opening at a first end thereof, the speaker opening being configured to receive a speaker therein, the enclosure housing having an inner surface facing the internal volume and an outer surface, the enclosure further defining at least one port communicating between the internal volume and the outer surface, the at least one port extending between the inner and outer surfaces along a port length that is greater than a maximum housing thickness between the inner and outer surfaces. The speaker enclosure can be made by arranging an inner speaker enclosure shell within an outer speaker enclosure shell such that the port is defined therebetween.

23 Claims, 7 Drawing Sheets

(56) References Cited

U.S. PATENT DOCUMENTS

| | | | | |
|---|---|---|---|---|
| 6,634,455 | B1 * | 10/2003 | Yang | 181/156 |
| 6,648,098 | B2 * | 11/2003 | Nichols | 181/193 |
| 6,973,994 | B2 * | 12/2005 | Mackin et al. | 181/156 |
| 7,051,835 | B2 * | 5/2006 | Martikainen | 181/156 |
| 7,201,252 | B2 * | 4/2007 | Nevill | 181/151 |
| 7,284,638 | B1 * | 10/2007 | Sahyoun | 181/156 |
| 2009/0173567 | A1 * | 7/2009 | Stiles | 181/148 |

* cited by examiner

PORTED AUDIO SPEAKER ENCLOSURES

CROSS-REFERENCE TO RELATED APPLICATION

This application claims the benefit of U.S. Provisional Patent Application Ser. No. 61/656,658, filed on Jun. 7, 2012, the contents of which are herein incorporated by reference in their entirety.

FIELD OF THE INVENTION

The present invention relates to audio speakers, and more particularly, to ported enclosures for audio speakers.

BACKGROUND OF THE INVENTION

Improvements in the design and construction of speaker drivers have allowed for smaller and smaller speaker cabinets or enclosures. This sometimes results in an enclosure that will not accommodate a port of optimal dimensions for the speaker. For example, a 10"×10"×10" box-shaped enclosure will not hold a port that is 3" in diameter and 28" long. While one could theoretically attach a 28"×3" tube to the back of the enclosure, it would not be practical or aesthetically pleasing. Moreover, it would defeat the point of minimizing the size of the speaker driver and the enclosure in the first place.

SUMMARY OF THE INVENTION

In view of the foregoing, it is an object of the present invention to provide an improved ported enclosure for an audio speaker. According to an embodiment of the present invention, an audio speaker enclosure comprises an enclosure housing defining an internal volume with a speaker opening at a first end thereof, the speaker opening being configured to receive a speaker therein, the enclosure housing having an inner surface facing the internal volume and an outer surface, the enclosure further defining at least one port communicating between the internal volume and the outer surface, the at least one port extending between the inner and outer surfaces along a port length that is greater than a maximum housing thickness between the inner and outer surfaces.

According to a method aspect, a method of making an audio speaker comprises arranging an inner speaker enclosure shell within an outer speaker enclosure shell such that at least one port is defined therebetween extending along a port length greater than a maximum distance between the inner and outer shells.

According to a further method aspect, a method of improving speaker performance comprises routing sound from a rear side of speaker through a circuitous port formed between inner and outer surfaces of a wall of the speaker enclosure.

These and other objects, aspects and advantages of the present invention will be better appreciated in view of the drawings and following detailed description of preferred embodiments.

DETAILED DESCRIPTION OF PREFERRED EMBODIMENTS

Figure 1:
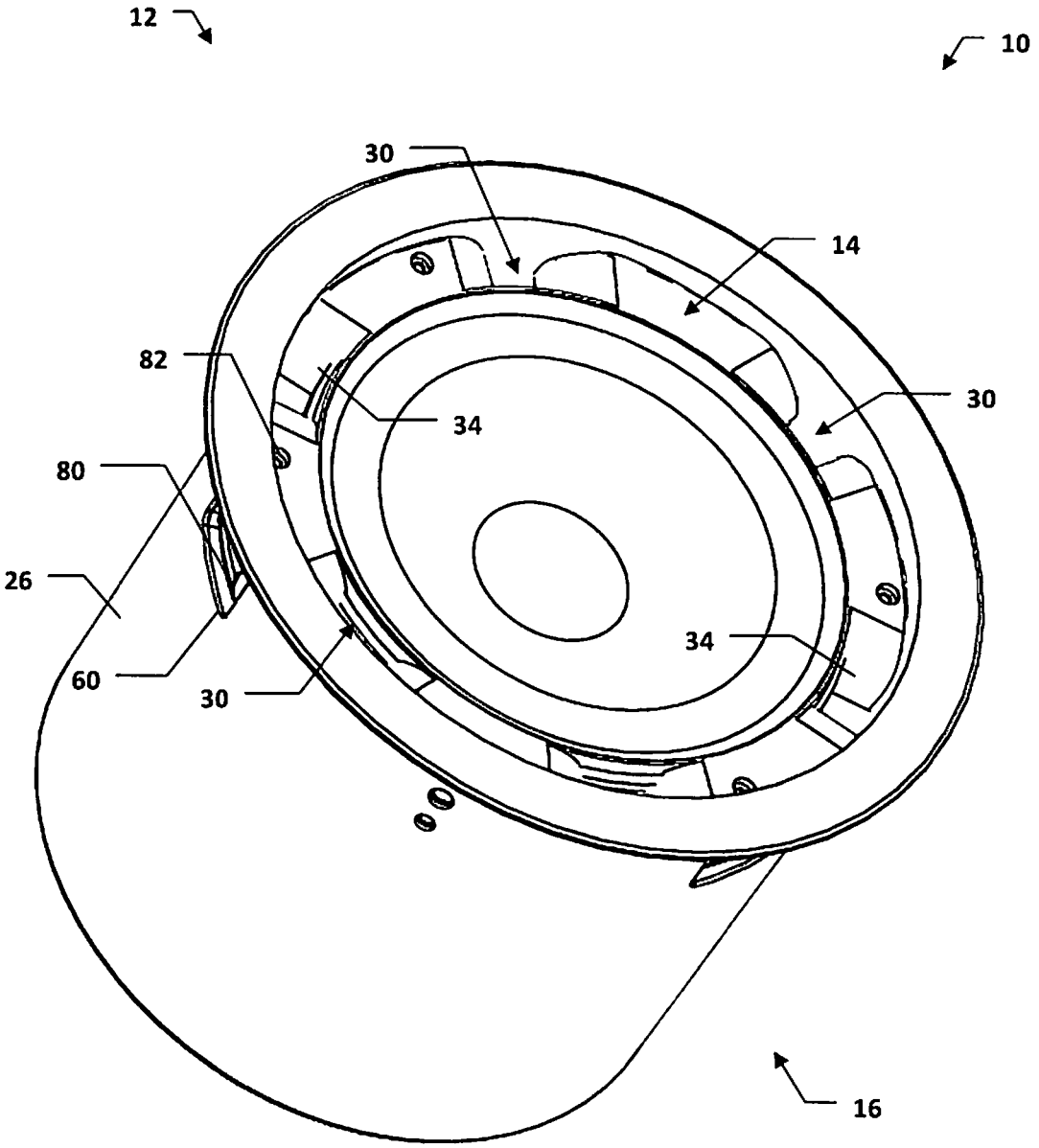
FIG. 1 is a perspective view of a speaker with a ported enclosure, according to an embodiment of the present invention.
Figure 2:
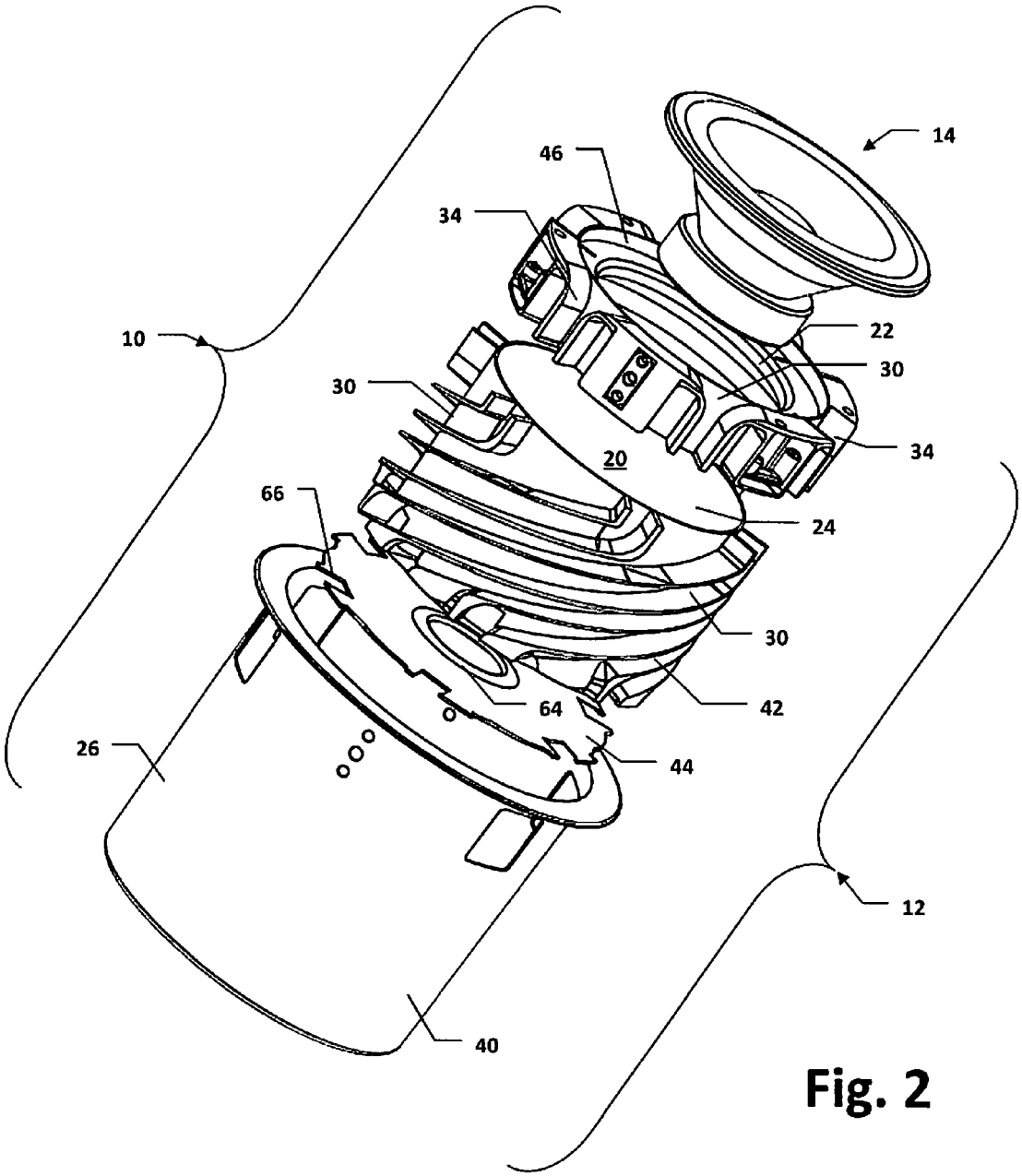
FIG. 2 is an exploded perspective view of the speaker of FIG. 1.

Referring to FIGS. 1 and 2, an audio speaker assembly 10 includes an audio speaker enclosure 12 and a speaker 14 housed thereby. The enclosure 12 includes an enclosure housing 16 that defines an internal volume 20 with a speaker opening 22 configured to receive and be sealed by the speaker 14 at a first end thereof. The enclosure housing 16 has an inner surface 24, facing the internal volume 20, and an outer surface 26. A plurality of ports 30 communicate between the internal volume 20 and the outer surface 26. The ports 30 extend between the inner and outer surfaces 24, 26 along a port length that is greater than a maximum housing thickness between the inner and outer surfaces 24, 26.

Figure 3:
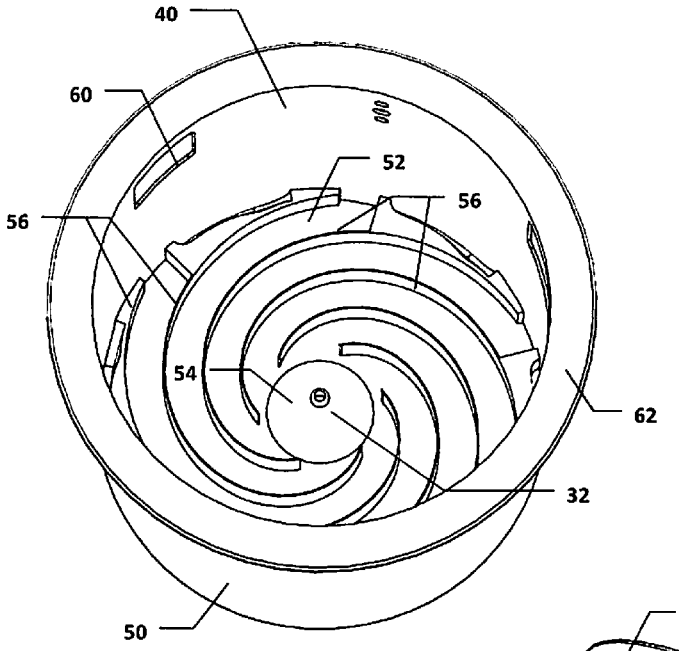
FIG. 3 is a perspective view of an outer shell of the speaker of FIG. 1.

Advantageously, the ports 30 wind at least partially around a perimeter of the enclosure housing 16 between the inner and outer surfaces 24, 26. In the depicted embodiment, referring also to FIG. 3, the ports 30 have inlets at a second end of the internal volume 20, in the form of a common inlet plenum 32, and outlets 34 surrounding the speaker opening 22 on the first end.

To facilitate manufacturing, the audio speaker enclosure 12 can be constructed from multiple components, including an outer shell 40, and inner shell 42, an end plate 44 and an end cap 46. These components define portions of the inner and/or outer surfaces 24, 26 and, when assembled, define the ports 30 therebetween.

Figure 4:
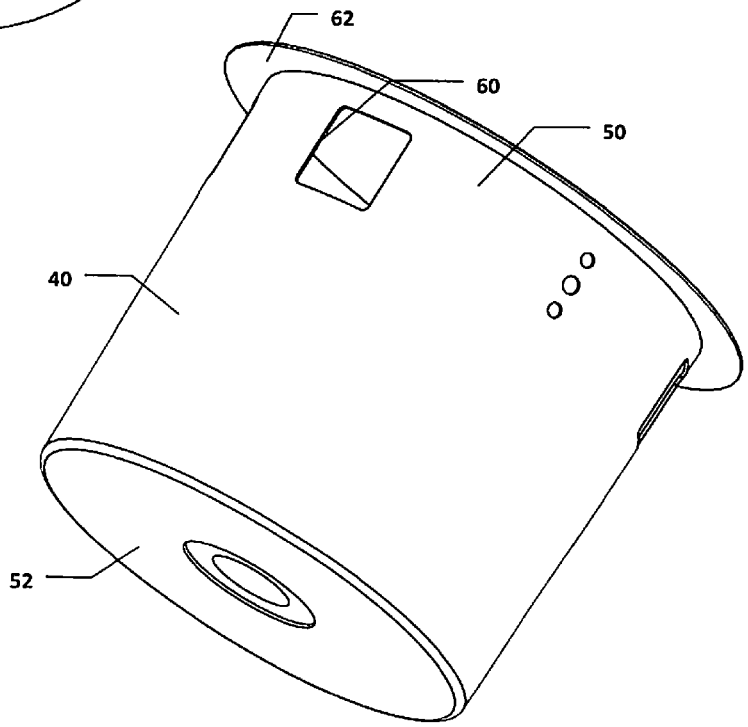
FIG. 4 is a another perspective view of the outer shell of FIG. 3.
Figure 5:
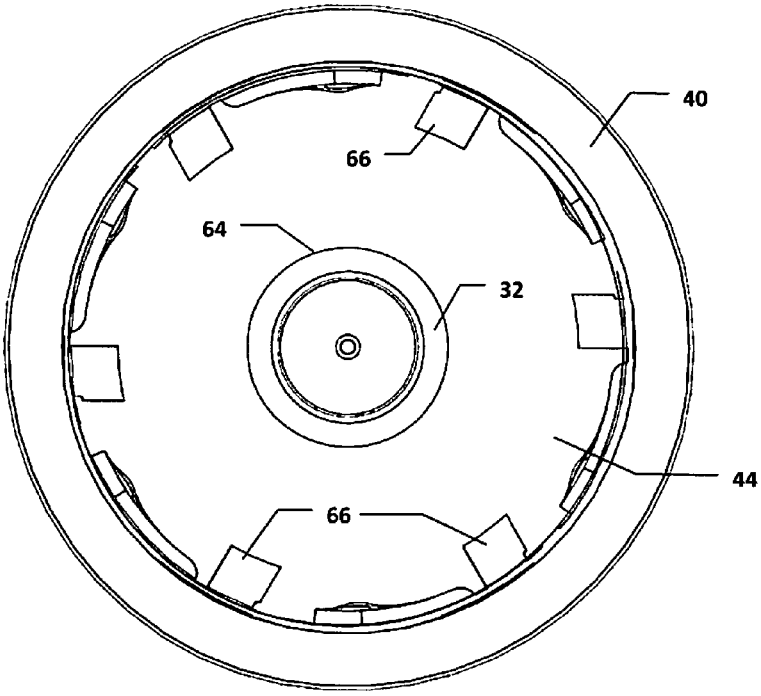
FIG. 5 is an end view of the outer shell of FIG. 3, with an end plate arranged therein.

Referring to FIGS. 4 and 5, the outer shell 40 has a generally cylindrical sidewall 50, open at a first end thereof and with a closed bottom wall 52 at a second end thereof. The bottom wall 52 has a raised central portion 54 on its inner surface, along with a plurality of first port walls 56 spiraling radially outward therefrom. A plurality of ceiling mount openings 60 are defined through the sidewall 50 around the first end, and a mounting flange 62 extends outwardly from the first end. Advantageously, the first port walls 56 and mounting flange 62 are molded or otherwise formed integrally with the outer shell 40.

Referring to FIGS. 2 and 5, the end plate 44 fits into the end of the outer shell 40 between upper edges of the first port walls 56 and the bottom of the inner shell 42. The end plate 44 has a central opening 64 and a plurality of perimetric openings 66. The central opening 64 defines an inlet of the inlet plenum 32. The first port walls 56 define first port sections between the inlet plenum 32 and the perimetric opening 66. Alternately, the end plate 44 could be incorporated into a first end of the inner shell 42.

Figure 6:
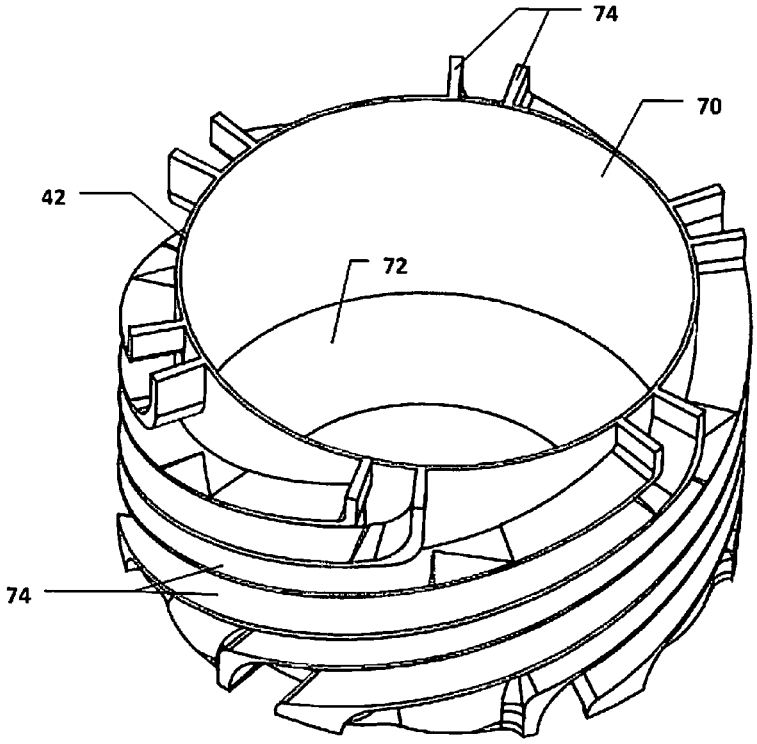
FIG. 6 is a perspective view of an inner shell of the speaker of FIG. 1.
Figure 7:
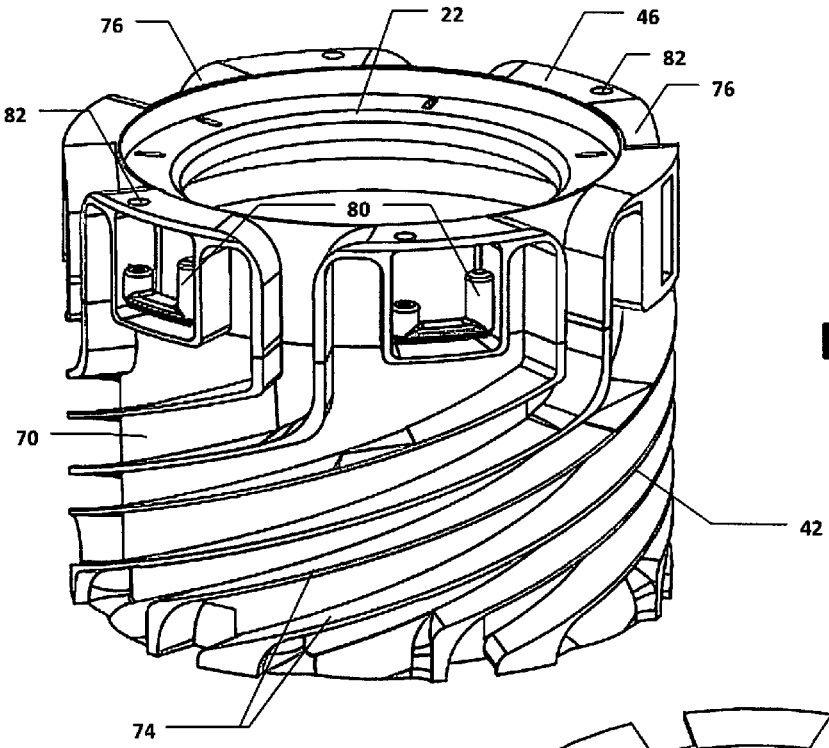
FIG. 7 is a perspective view of the inner shell of FIG. 6, with an end cap arranged thereon.

Referring the FIGS. 6 and 7, the inner shell 42 includes a cylindrical wall 70 that is open at first and second ends thereof. Toward the second end there is preferably a tapered section 72, where the inner surface of the wall 70 slopes inwardly to engage the end plate 44 around the central opening 64 thereof. A plurality of second port walls 74 extend outwardly from the outer surface of the wall 70, such that second port sections are defined between the inner and outer shells 40, 42 by the second port walls 74. The second port sections begin at the ends of the first port sections, communicating through the perimetric openings 66, and end at the first end of the inner shell 42.

The end cap 46 sealingly bridges the outer and inner shells 40, 42, except where a plurality of port outlets 76 align with the first ends of second port walls 74. The end cap 46 also particularly defines the speaker opening 22. Additionally, referring to FIGS. 1 and 7, a plurality of ceiling mounts 80 are connected to the end cap. When the enclosure housing 16 is assembled, the mounts 80 are aligned with the ceiling mount openings 60 in the outer shell 40. The ceiling mounts 80 are pivotable outward through the openings 60 to hold the speaker assembly 10 in place when installed through a ceiling, wall or other surface. The ceiling mounts 80 are accessible for operation during installation via openings 82 in the end cap 42.

Figure 8:
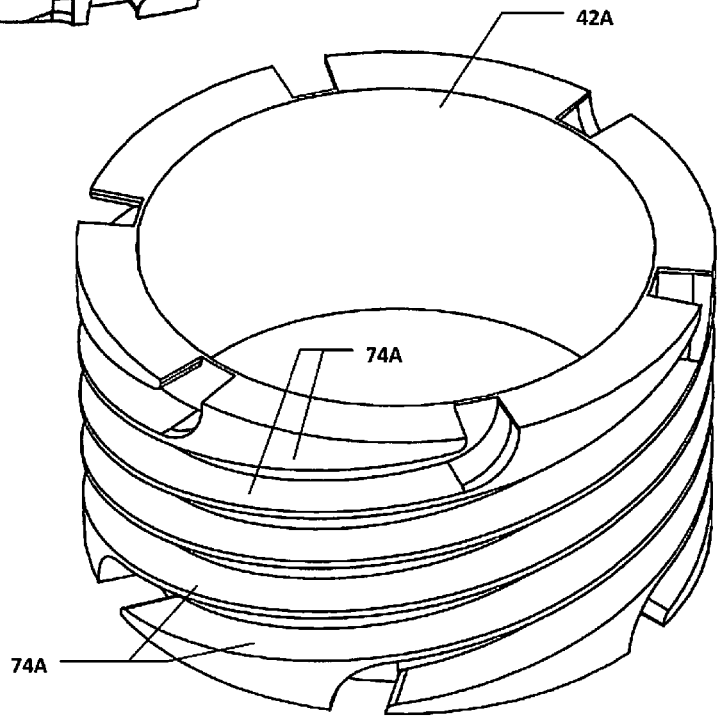
FIG. 8 is a perspective view of an alternate inner shell, usable in place of the inner shell of FIG. 6.

This modular construction of the enclosure housing 16 advantageously allows port length to be varied without changing most of the components. For example, referring to FIG. 8, an alternate inner shell 42A has second port walls 74A with a more gradual slope than the port walls 74. As a result, the second port sections formed by the port walls 74A are longer than those formed by the port walls 74, and the overall length of ports is corresponding increased. However, the number of ports formed by the port walls 74A and the alignment of their first and second ends is not changed from the inner shell 42. Accordingly, the inner shell 42 and the inner shell 42A could be substituted without changing any of the other components.

Figure 9:
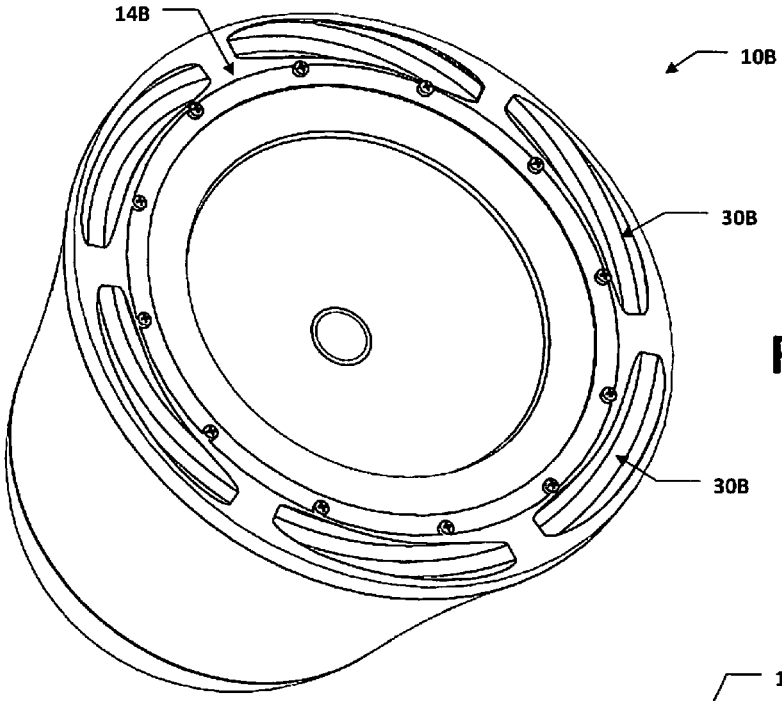
FIG. 9 is a perspective view of a speaker with a ported enclosure, according to another embodiment of the present invention.
Figure 10:
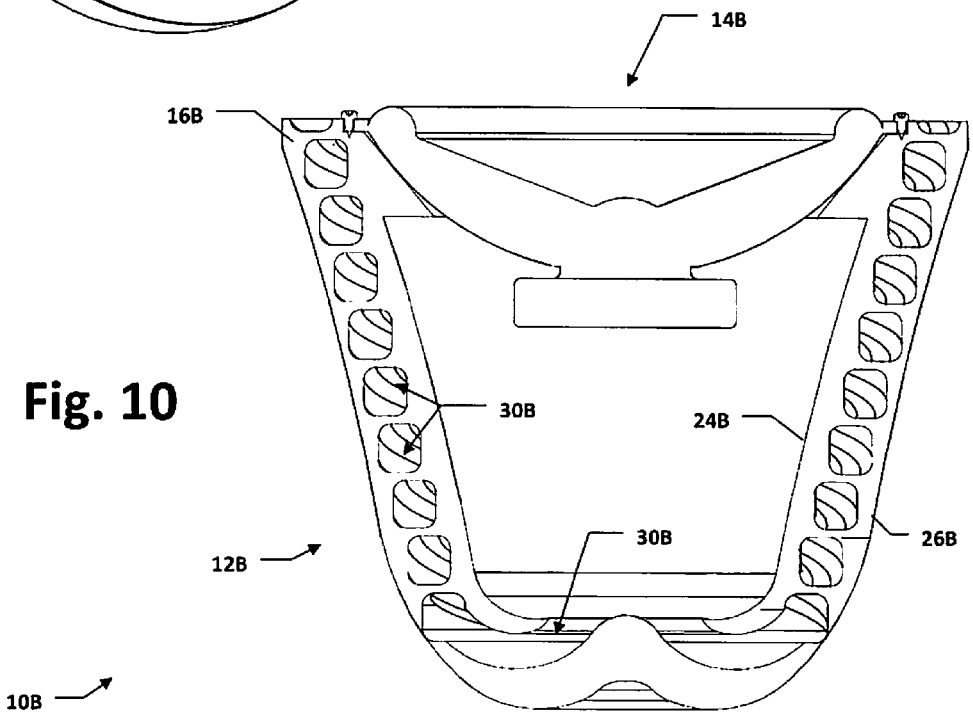
FIG. 10 is a sectional view of the speaker of FIG. 9.

While the modular enclosure housing 16 represents a highly advantageous embodiment of the present invention, the present invention can be embodied in many other ways. For example, referring to FIGS. 9 and 10, a speaker assembly 10B includes a speaker enclosure 12B and a speaker 14B. In addition to representing another one of several enclosure geometries that can be realized in connection with present invention, the plurality of ports 30B are integrally molded or otherwise formed between the inner and outer housing surfaces 24B, 26B of the housing 16B.

Figure 11:
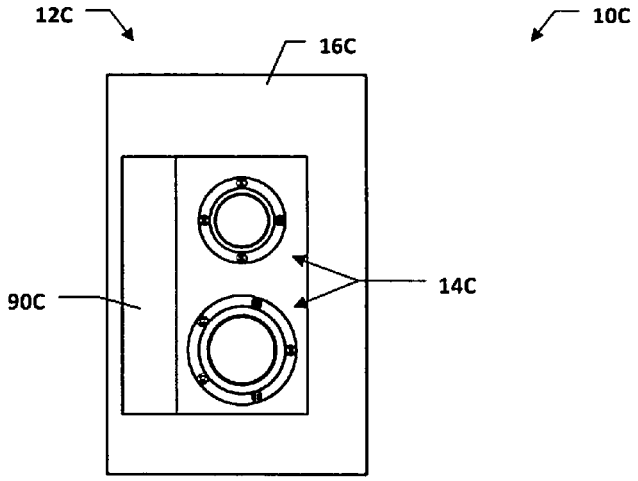
FIG. 11 is a perspective view of a speaker with a ported enclosure, according to a further embodiment of the present invention.
Figure 13:
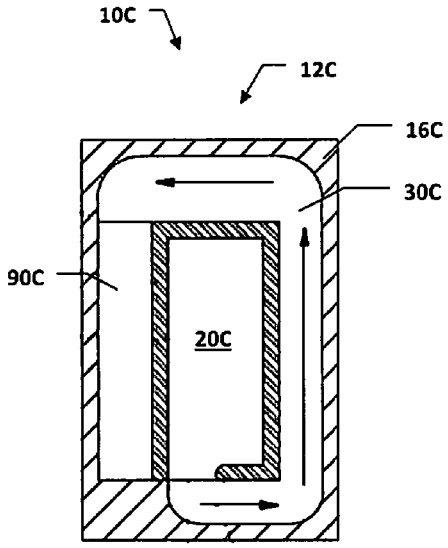
FIG. 13 is another sectional view of the speaker of FIG. 11.
Figure 12:
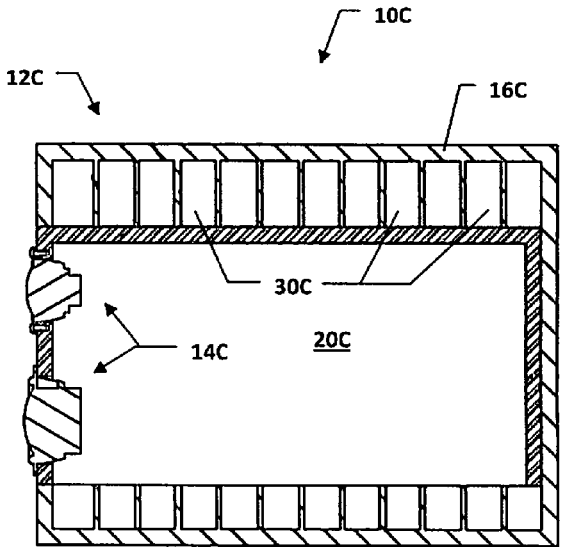
FIG. 12 is a sectional view of the speaker of FIG. 11.

Referring to FIGS. 11-13, a speaker assembly 100 includes a speaker enclosure 12C and two speakers 14C. The speaker assembly 100 demonstrates yet another geometry that can be realized when implementing the present invention. Also notably, more than one speaker 14C can be mounted in the speaker opening of the enclosure housing 16C. Additionally, the ports 30C each begin at the internal volume 20C and terminate in a common outlet plenum 90C, which is directed toward the first end of the housing 16C.

With the advancements in plastic, carbon fiber, aluminum machining and other materials the speaker cabinet can be changed to accommodate a longer port without significantly increasing its overall dimensions. For instance, many speaker cabinets are made of a ¾" MDF or other type material some cabinets have 1" or 2" sidewalls. By using instead multiple thin walls with fins or veins inside the wall to add structural stability those veins can then be used as the port for the main chamber or as a transmission line for the back wave of the speaker. Thus the port can vary in diameter or size and can also be varied in length by how it is channeled through the sidewalls of the enclosure.

By breaking the air down into veins that channel through the wall of the enclosure, increasing the distance traveled by the air and initiating a spin that can also impact air velocity. This type of design works with both in room and in-wall speaker enclosure (commonly called architectural speakers), as well as speakers in vehicular applications (e.g., automobiles, boats, etc.). With this style of port the port diameter can stay constant of constrict or expand. This would allow the air volume to be more or less pressurized. It would also allow for different chambers or veins to be of different lengths or size. The ports could also employ a horn type of design.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. An audio speaker enclosure comprising:

an enclosure housing defining an internal volume with a speaker opening at a first end thereof, the speaker opening being configured to receive a speaker therein, the enclosure housing having an inner surface facing the internal volume and an outer surface, the enclosure further defining at least two ports communicating between the internal volume and the outer surface, the at least two ports extending between the inner and outer surfaces along a port length that is greater than a maximum housing thickness between the inner and outer surfaces;

wherein each of the at least two ports includes a first port section, extending towards a perimeter of the enclosure housing between the inner and outer surfaces at a second end of the internal volume opposite the first end, and a second port section, extending between the inner and outer surfaces from the first port section at the perimeter, winding at least partially around a perimeter of the enclosure housing toward the outer surface.

2. The audio speaker enclosure of claim 1, wherein each of the at least two ports has an inlet at the second end.

3. The audio speaker enclosure of claim 2, wherein each of the at least two ports has an outlet at the first end.

4. The audio speaker enclosure of claim 2, wherein each of the at least two ports begins at a common inlet plenum defined at the second end.

5. The audio speaker enclosure of claim 1, wherein the enclosure housing includes an inner shell and an outer shell, the at least two ports being defined between the inner and outer shells.

6. The audio speaker enclosure of claim 5, wherein a plurality of port walls extend between the inner and outer shells, the at least two ports being defined therebetween.

7. The audio speaker enclosure of claim 6, wherein, for each of the at least two ports, the first port section extends between the inner and outer shells at the second end of the internal volume opposite the first end, and the second port section extends between the inner and outer shells winding at least partially around the perimeter.

8. The audio speaker enclosure of claim 7, wherein the plurality of port walls of the first port section are formed integrally with the outer shell and the plurality of port walls of the second port section are formed integrally with the inner shell.

9. The audio speaker enclosure of claim 7, wherein the audio speaker enclosure further includes an end plate arranged between the inner and outer shells at the second end, the end plate having a central opening communicating between the internal volume and the first section and at least two perimetric openings communicating, respectively for each of the at least two ports, between the first port section and the second port section.

10. The audio speaker of claim 5, wherein the audio speaker enclosure further includes an end cap arranged at the first end surrounding the speaker opening and bridging the inner and outer shells.

11. The audio speaker of claim 10, wherein the end cap defines an outlet for each of the at least two ports.

12. The audio speaker of claim 10, wherein the end cap includes at least one pivotable ceiling mount support.

13. An audio speaker enclosure comprising:

an enclosure housing defining an internal volume with a speaker opening at a first end thereof, the speaker opening being configured to receive a speaker therein, the enclosure housing having an inner surface facing the internal volume and an outer surface, the enclosure further defining at least one port communicating between the internal volume and the outer surface, the at least one port extending between the inner and outer surfaces along a port length that is greater than a maximum housing thickness between the inner and outer surfaces;

wherein the at least one port includes a first port section, extending circuitously towards a perimeter of the enclosure housing between the inner and outer surfaces and first port section walls at a second end of the internal volume opposite the first end, and a second port section, extending between the inner and outer surfaces from the first port section at the perimeter, winding at least partially around a perimeter of the enclosure housing toward the outer surface.

14. The audio speaker enclosure of claim 13, wherein the at least one port comprises a plurality of ports.

15. The audio speaker enclosure of claim 14, wherein the plurality of ports begin at a common inlet plenum defined between the inner and outer surfaces and the second end of the interval volume.

16. The audio speaker of claim 13, wherein the audio speaker enclosure further includes an end cap arranged at the first end surrounding the speaker opening, bridging the inner and outer surfaces and defining an outlet for the at least one port.

17. An audio speaker enclosure comprising:

an enclosure housing defining an internal volume with a speaker opening at a first end thereof, the speaker opening being configured to receive a speaker therein, the enclosure housing having an inner surface facing the internal volume and an outer surface, the enclosure further defining at least one port communicating between the internal volume and the outer surface, the at least one port extending between the inner and outer surfaces along a port length that is greater than a maximum housing thickness between the inner and outer surfaces;

wherein the at least one port includes a first port section, extending from an inlet plenum towards a perimeter of the enclosure housing between the inner and outer surfaces and first port section walls at a second end of the internal volume opposite the first end, and a second port section, extending between the inner and outer surfaces from the first port section at the perimeter, winding at least partially around a perimeter of the enclosure housing toward the outer surface; and wherein a diameter of the inlet plenum is greater than a distance between the first port section walls.

18. The audio speaker enclosure of claim 17, wherein the at least one port comprises a plurality of ports.

19. The audio speaker enclosure of claim 17, wherein the at least one port has an outlet at the first end.

20. The audio speaker enclosure of claim 17, wherein the audio speaker enclosure further includes an end plate arranged between the internal volume and the inlet plenum at the second end, the end plate having a central opening communicating between the internal volume and the inlet plenum and at least one perimetric opening communicating between the first port section and the second port section.

21. The audio speaker of claim 17, wherein the audio speaker enclosure further includes an end cap arranged at the first end surrounding the speaker opening and bridging the inner and outer surfaces.

22. The audio speaker of claim 21, wherein the end cap defines an outlet for the at least one port.

23. The audio speaker of claim 21, wherein the end cap includes at least one pivotable ceiling mount support.

* * * * *